United States Patent [19]

Mandel

[11] 4,042,067

[45] Aug. 16, 1977

[54] ELEVATOR SYSTEM

[75] Inventor: Alan F. Mandel, Pittsburgh, Pa.

[73] Assignee: Westinghouse Electric Corporation, Pittsburgh, Pa.

[21] Appl. No.: 578,303

[22] Filed: May 16, 1975

[51] Int. Cl.[2] ..... B66B 1/16

[52] U.S. Cl. ..... 187/29 R; 340/19 R

[58] Field of Search ..... 187/29; 340/19, 21

[56] References Cited

U.S. PATENT DOCUMENTS

| | | | |
|---|---|---|---|
| 3,782,504 | 1/1974 | Billmaier et al. | 187/29 |
| 3,841,443 | 10/1974 | Booker, Jr. | 187/29 |
| 3,851,735 | 12/1974 | Winkler et al. | 187/29 |
| 3,903,499 | 9/1975 | Oliver | 340/19 |

*Primary Examiner*—Robert K. Schaefer

*Assistant Examiner*—W. E. Duncanson, Jr.

*Attorney, Agent, or Firm*—D. R. Lackey

[57] ABSTRACT

An elevator system including an elevator car mounted for movement in a building to serve the floors therein, and a call entry and display station for registering calls for destination floors. The call entry panel includes a plurality of switches, and notations which identify the floor each switch is associated with. A selector sequentially addresses the switches responsive to addresses provided by a programmed memory. The memory is programmed at the factory according to the desired notational sequence applied to the switches, which enables the physical arrangement of the switches and the wiring thereof to be standardized. New and improved apparatus for monitoring a plurality of switches, is also disclosed.

16 Claims, 10 Drawing Figures

| PROM INPUT MSB LSB | PROM OUTPUT (UNUSED) | D | C | B | A | SWITCH # | FLOOR # |
|---|---|---|---|---|---|---|---|
| 0 1 1 1 1 | | 1 | 1 | 1 | 1 | S15 | 17 |
| 0 1 1 1 0 | | 1 | 0 | 1 | 1 | S11 | 16 |
| 0 1 1 0 1 | | 0 | 1 | 1 | 1 | S7 | 15 |
| 0 1 1 0 0 | | 0 | 0 | 1 | 1 | S3 | 14 |
| 0 1 0 1 1 | | 1 | 1 | 1 | 0 | S14 | 12 |
| 0 1 0 1 0 | | 1 | 0 | 1 | 0 | S10 | 11 |
| 0 1 0 0 1 | | 0 | 1 | 1 | 0 | S6 | 10 |
| 0 1 0 0 0 | | 0 | 0 | 1 | 0 | S2 | 9 |
| 0 0 1 1 1 | | 1 | 1 | 0 | 1 | S13 | 8 |
| 0 0 1 1 0 | | 1 | 0 | 0 | 1 | S9 | 7 |
| 0 0 1 0 1 | | 0 | 1 | 0 | 1 | S5 | 6 |
| 0 0 1 0 0 | | 0 | 0 | 0 | 1 | S1 | 5 |
| 0 0 0 1 1 | | 1 | 1 | 0 | 0 | S12 | 4 |
| 0 0 0 1 0 | | 1 | 0 | 0 | 0 | S8 | 3 |
| 0 0 0 0 1 | | 0 | 1 | 0 | 0 | S4 | 2 |
| 0 0 0 0 0 | | 0 | 0 | 0 | 0 | S0 | L |

| PROM INPUT MSB LSB | PROM OUTPUT (UNUSED) | D | C | B | A | SWITCH # | FLOOR # |
|---|---|---|---|---|---|---|---|
| 0 1 1 1 1 | | 1 | 1 | 1 | 1 | S15 | — |
| 0 1 1 1 0 | | 1 | 1 | 1 | 1 | S15 | — |
| 0 1 1 0 1 | | 1 | 1 | 1 | 1 | S15 | — |
| 0 1 1 0 0 | | 1 | 1 | 1 | 1 | S15 | — |
| 0 1 0 1 1 | | 1 | 1 | 1 | 1 | S15 | — |
| 0 1 0 1 0 | | 1 | 1 | 1 | 1 | S15 | — |
| 0 1 0 0 1 | | 1 | 1 | 1 | 1 | S15 | — |
| 0 1 0 0 0 | | 1 | 1 | 1 | 1 | S15 | — |
| 0 0 1 1 1 | | 1 | 1 | 1 | 0 | S14 | 8 |
| 0 0 1 1 0 | | 1 | 1 | 0 | 1 | S13 | 7 |
| 0 0 1 0 1 | | 1 | 0 | 1 | 0 | S10 | 6 |
| 0 0 1 0 0 | | 1 | 0 | 0 | 1 | S9 | 5 |
| 0 0 0 1 1 | | 0 | 1 | 1 | 0 | S6 | 4 |
| 0 0 0 1 0 | | 0 | 1 | 0 | 1 | S5 | 3 |
| 0 0 0 0 1 | | 0 | 0 | 1 | 0 | S2 | 2 |
| 0 0 0 0 0 | | 0 | 0 | 0 | 1 | S1 | L |

| PROM INPUT MSB LSB | PROM OUTPUT (UNUSED) | D C B A MSB LSB | SWITCH # | FLOOR # |
|---|---|---|---|---|
| 0 1 1 1 1 | | 1 1 0 0 | S15 | 17 |
| 0 1 1 1 0 | | 1 0 0 0 | S14 | 16 |
| 0 1 1 0 1 | | 0 1 0 0 | S13 | 15 |
| 0 1 1 0 0 | | 0 0 0 0 | S12 | 14 |
| 0 1 0 1 1 | | 1 1 0 1 | S11 | 12 |
| 0 1 0 1 0 | | 1 0 0 1 | S10 | 11 |
| 0 1 0 0 1 | | 0 1 0 1 | S9 | 10 |
| 0 1 0 0 0 | | 0 0 0 1 | S8 | 9 |
| 0 0 1 1 1 | | 1 1 1 0 | S7 | 8 |
| 0 0 1 1 0 | | 1 0 1 0 | S6 | 7 |
| 0 0 1 0 1 | | 0 1 1 0 | S5 | 6 |
| 0 0 1 0 0 | | 0 0 1 0 | S4 | 5 |
| 0 0 0 1 1 | | 1 1 1 1 | S3 | 4 |
| 0 0 0 1 0 | | 1 0 1 1 | S2 | 3 |
| 0 0 0 0 1 | | 0 1 1 1 | S1 | 2 |
| 0 0 0 0 0 | | 0 0 1 1 | S0 | L |

FIG.9

| PROM INPUT MSB LSB | PROM OUTPUT (UNUSED) | D C B A | SWITCH # | FLOOR # |
|---|---|---|---|---|
| 0 1 1 1 1 | | 1 1 0 0 | S15 | 17 |
| 0 1 1 1 0 | | 1 1 0 1 | S11 | 16 |
| 0 1 1 0 1 | | 1 1 1 0 | S7 | 15 |
| 0 1 1 0 0 | | 1 1 1 1 | S3 | 14 |
| 0 1 0 1 1 | | 1 0 0 0 | S14 | 12 |
| 0 1 0 1 0 | | 1 0 0 1 | S10 | 11 |
| 0 1 0 0 1 | | 1 0 1 0 | S6 | 10 |
| 0 1 0 0 0 | | 1 0 1 1 | S2 | 9 |
| 0 0 1 1 1 | | 0 1 0 0 | S13 | 8 |
| 0 0 1 1 0 | | 0 1 0 1 | S9 | 7 |
| 0 0 1 0 1 | | 0 1 1 0 | S5 | 6 |
| 0 0 1 0 0 | | 0 1 1 1 | S1 | 5 |
| 0 0 0 1 1 | | 0 0 0 0 | S12 | 4 |
| 0 0 0 1 0 | | 0 0 0 1 | S8 | 3 |
| 0 0 0 0 1 | | 0 0 1 0 | S4 | 2 |
| 0 0 0 0 0 | | 0 0 1 1 | S0 | L |

FIG.10

ELEVATOR SYSTEM

BACKGROUND OF THE INVENTION

1. Field of the Invention

The invention relates in general to elevator systems, and more specifically to new and improved car call entry and display stations for entering calls for desired destination floors. The invention also relates to new and improved apparatus for monitoring a plurality of switches.

2. Description of the Prior Art

It is conventional in elevator systems to provide at least one car call entry and display station in each elevator car for registering car calls for desired destination floors of the passengers. The car call station includes a plurality of switches, usually pushbuttons, along with identifying notations which indicate the floor each switch is associated with. The plurality of switches are arranged in a square or rectangular format, with the switch at the lower left-hand corner usually being associated with the lowest floor in the building, and the switch at the upper right-hand corner usually being associated with the highest floor in the building. The switches may be numbered horizontally, or vertically, as specified by the building architect.

The stationary contacts of the pushbuttons may be the conventional discrete contacts of a conventional discrete pushbutton; or, the stationary contacts of all of the pushbuttons may be etched or plated on a common printed circuit board. The stationary contacts of the switches may be connected in parallel, or they may be connected in a matrix which is scanned, for either the discrete pushbutton arrangement, or the printed circuit board arrangement of the switches. The means for operating each switch is preferably a movable contact which, when depressed, forms a direct metallic connection between the stationary contacts, or it may simply move a movable contact closer to the stationary contacts to change their capacitive relationship. In the latter arrangement, the change in capacitance is utilized to detect operation of the pushbutton. A movable contact is preferred since it does not depend upon body capacitance to earth ground, and it is thus not difficult to operate by a person wearing gloves, and it is not subject to false operation by ionized air during a fire, which creates an electrical path from the switch to earth ground. However, proximity or touch contact switches with no movable electrodes may be used in combination with a smoke and/or heat sensor which disables the car call switches and returns the elevator car to a specified floor.

Regardless of the type of switch used, and the type of interconnections between the switches, it would be desirable to standardize the factory wiring of the car call station, and to standardize the connections which are made to the car call station in the field. The printing of the stationary contacts of all of the pushbuttons on a common printed circuit board, and their interconnection in a matrix, is a step in the direction of simplifying and standardizing the shop and field wiring. However, the advantages of such batch fabrication are offset by the fact that the notations on the switches identifying the floor they are associated with may run horizontally on one elevator installation, and vertically on the next, depending upon the specifications of the building architect. Also, when the building has fewer floors than the number of switches disposed on the common printed circuit board, the wiring of a matrix printed circuit board switch arrangement would be non-standard, as only certain switches on the printed circuit board would be used, and the notations on these selected switches may run horizontally, or vertically, as specified.

SUMMARY OF THE INVENTION

Briefly, the present invention is a new and improved elevator system, and a new and improved switch monitoring apparatus which may be used for monitoring a plurality of switches, such as in an elevator installation, which inventions enable the shop and field wiring of the car call station to be simplified and standardized, as well as making it economically feasible to batch fabricate the stationary contacts of the switches on a common printed circuit board. The car call station for entering and displaying car calls includes a plurality of switches and associated notations which identify the floor number the switch is associated with, with the numbering of the notations increasing horizontally, or vertically, as specified. A selector is provided which, when addressed by a unique signal which identifies the physical location of a switch, will monitor the selected switch to determine if it is being operated to register a car call. A binary counter is rapidly and continuously clocked through its count value, and a programmable integrated circuit memory device, such as a programmable read-only memory, is programmed for each elevator installation to provide predetermined switch addresses for the selector in response to predetermined count values of the binary counter. The switch addresses are provided by the memory device in a sequence which directs the selector to monitor the switches in the order selected by the floor number identifying notations associated with the switches. Thus, the switches may be factory and field wired identically for each installation, for either horizontally or vertically increasing switch notations, and when the switches are batch fabricated on a printed circuit board, fewer than the total number of switches available may be selected in any order without changing the wiring of the car call station.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIGS. 9 and 10 are charts which illustrate the programming of a read-only memory used in the FIG. 8 embodiment, for horizontally and vertically increasing notations, respectively, on the switches.

DESCRIPTION OF PREFERRED EMBODIMENTS

Figure 1:
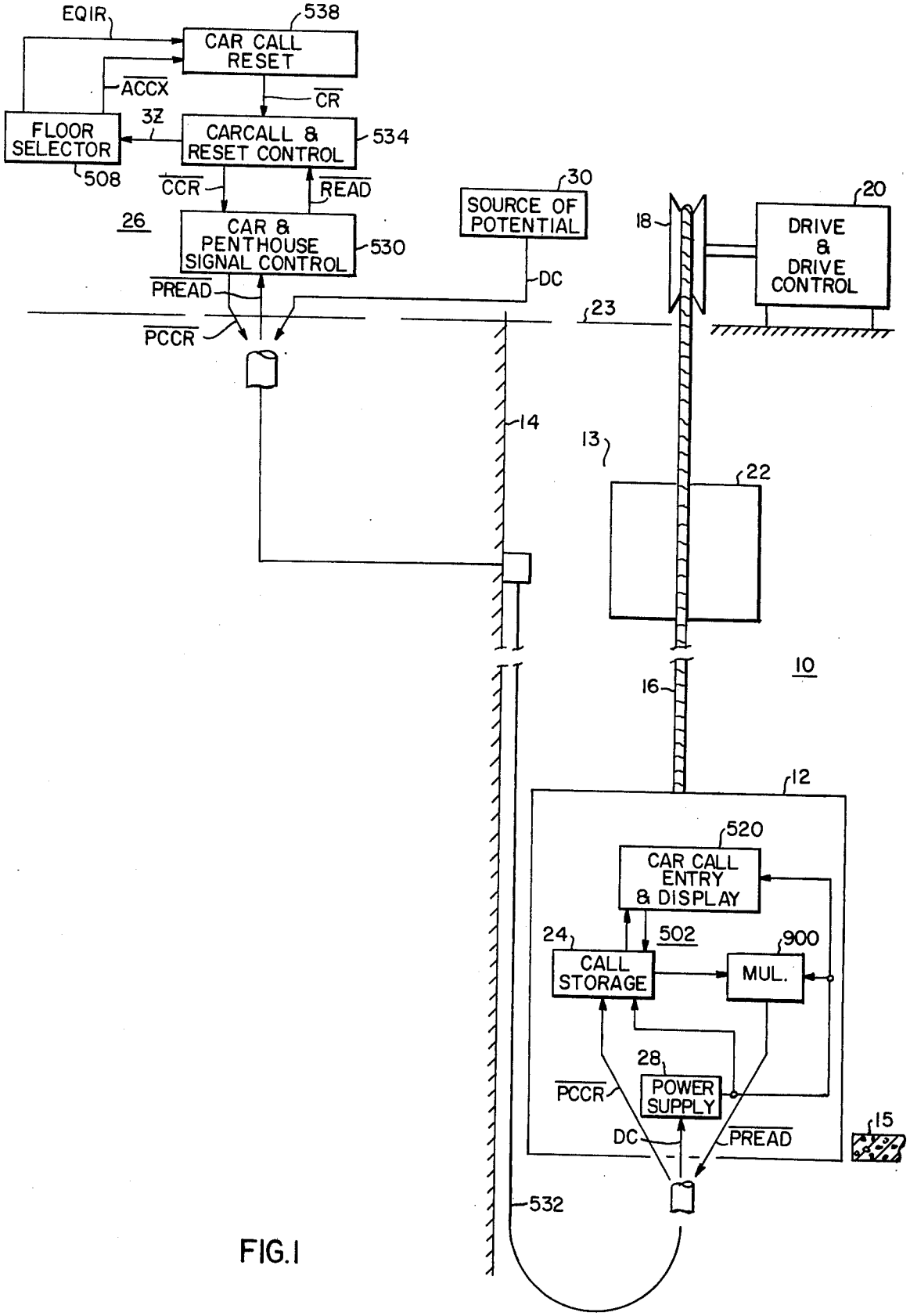
FIG. 1 is a diagrammatic representation of an elevator system which may utilize the teachings of the invention.

Referring now to the drawings, and FIG. 1 in particular, there is shown an elevator system 10 of the type which may utilize the teachings of the invention. While the elevator system 10 illustrated in FIG. 1 is of the traction type, it is to be understood that the invention is equally applicable to elevator systems with any type of motive means, such as hydraulic elevators.

Only that part of a complete elevator system necessary to understand the invention is shown in FIG. 1. For purposes of example, it will be assumed that the elevator system 10 utilizes the floor selector and other car control disclosed in U.S. Pat. No. 3,750,850. U.S. Pat. No. 3,807,531 discloses modifications to the floor selector shown in U.S. Pat. No. 3,750,850 for group supervisory control by a system processor, as well as new and improved apparatus for serializing and multiplexing car calls from the car station over the traveling cable to the remotely located floor selector. The elevator system disclosed in these patents continuously generates scan or time slots in a binary scan counter, with the floors of the associated building each being assigned to a different scan slot. Floor related information is serialized and it appears in the scan slot assigned to that floor. These U.S. patents, which are assigned to the same assignee as the present application, are hereby incorporated into the present application by reference. Where applicable, the signals and reference numerals used in these incorporated patents will be used in the present application when describing similar signals and functions.

Elevator system 10 includes an elevator car 12 mounted in a hatchway 13 for movement relative to a structure or building 14 having a plurality of floors or landings, illustrated generally at 15. The elevator car 12 is supported by a plurality of wire ropes, shown generally at 16, which are reeved over a traction sheave 18 mounted on the shaft of a drive motor 20, such as a direct current motor as used in the Ward-Leonard drive system, or in a solid state drive system. A counterwight 22 is connected to the other end of the ropes 16. The drive motor 20 and its associated control are generally mounted in a penthouse, shown in general as being above the broken line 23. A car station 502 is mounted in the elevator car 12, and it includes a car call entry and display panel 520, means 24 for storing the car calls until they are reset by the response of the elevator car in servicing the call, and a multiplexer circuit 900 for multiplexing the car calls and other car station signals to provide a serial signal $\overline{\text{PREAD}}$ for transmission to the remotely located portion 26 of the car control over a traveling cable 532. The car station 502 also includes a power supply 28 which receives a unidirectional potential, referenced DC, from a penthouse source 30 via the traveling cable 532.

The car control 26 located remotely from the elevator car 12, may also be located in the penthouse with the drive and drive control 20. This portion of the car control includes a floor selector 508, car and penthouse signal control 530, car call and reset control 534, and car call reset control 538. The car and penthouse signal control 530 receives the signal $\overline{\text{PREAD}}$, separates the serialized car calls from the other car related signals, and sends the serialized car calls to the car call and reset control 534 at the signal $\overline{\text{READ}}$. The car call and reset control 534 sends serial car calls to the floor selector 508 as signal 3Z.

Car call reset control 538 receives a serial advanced car position signal EQIR, and an acceleration request signal $\overline{\text{ACCX}}$ from the floor selector 508. When signal $\overline{\text{ACCX}}$ goes high (to a logic one) it indicates a deceleration request has been made for the elevator car to stop at the floor of the advanced car position signal EQIR, and a car call reset signal $\overline{\text{CR}}$ is generated in the scan or time slot associated with the floor of the advanced car position. Serialized reset signals $\overline{\text{CR}}$ are sent to the car call and reset control 534 from the car call reset 538, the car call and reset control 534 sends serialized car call resets $\overline{\text{CCR}}$ to the car and penthouse signal control 530. The car and penthouse signal control 530 processes the car call resets and sends them to the call storage 24 in the car station 502, over the traveling cable 532, as serial signal $\overline{\text{PCCR}}$. The serialized reset signal resets the appropriate memory element in the call storage 24, and removes the car call registered indication on the car call entry and display panel 520.

Figure 2:
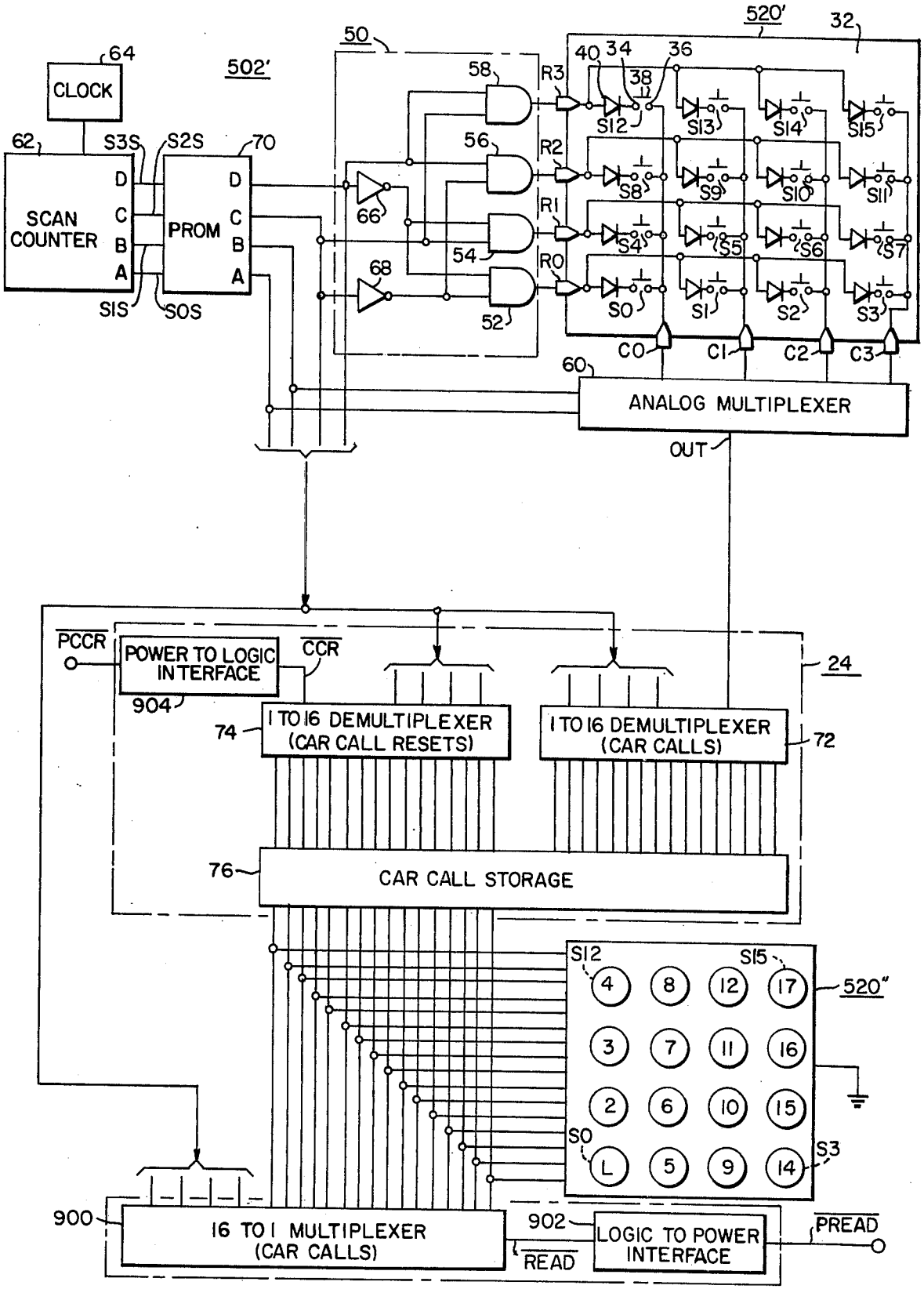
FIG. 2 is a schematic diagram of a car call entry and display station constructed according to the teachings of the invention, which may be used in the elevator system shown in FIG. 1.

FIG. 2 is a schematic diagram of a car call entry and display station 502', constructed according to an embodiment of the invention, which display station may be used for the car call entry and display station 502 shown in FIG. 1. The call entry and display panel 502 of FIG. 1 is shown divided into its two functions, with the call entry function being illustrated at 520', and the display function at 520". The display 520" usually includes indicating means, such as incandescent lamps, which are illuminated to indicate the registered car calls to be served by the elevator car. Since they may be conventional, they are illustrated in block form along with typical display notations arranged on the actuating portion of the pushbuttons.

The call entry function 520' includes a plurality of switches, such as 16, referenced S0 through S15, which are connected in an X–Y matrix in this embodiment of the invention. While the switches SO–S15 may be 16 individual pushbuttons, it is preferable that the switches S0–S15 be batch fabricated by plating, etching, or otherwise applying an electrically conductive coating to the surface of the printed circuit board 32, to form first and second stationary electrically conductive electrodes, elements or contacts of the switches, such as stationary electrodes 34 and 36, respectively, of switch S12. The means for actuating the switches S0–S15 may be a movable electrode or contact, such as movable electrode 38 of switch S12, which may form a metallic connection between the first and second stationary contacts when depressed, or which may simply move closer to the stationary contacts without actual metallic contact therewith, to change the capacitive relationship between the electrodes of the switch.

The stationary electrodes of the switches S0–S15 are electrically interconnected in an X–Y matrix by electrically connecting the first stationary electrodes of the switches S0, S1, S2 and S3 to terminal R0, by connecting the first stationary electrodes of switches S4, S5, S6 and S7 to terminal R1, by connecting the first stationary electrodes of switches S8, S9, S10 and S11 to terminal R2, and by connecting the first stationary electrodes of switches S12, S13, S14 and S15 to terminal R3. The matrix construction further requires the connecting of the second stationary electrodes of switches S0, S4, S8 and S12 to terminal C0, the connection of the second stationary electrodes of switches S1, S5, S9 and S13 to terminal C1, the connection of the second stationary electrodes of switches S2, S6, S10 and S14 to terminal C2, and the connection of the second stationary electrodes of switches S3, S7, S11 and S15 to terminal C3. The terminals R0 through R3 also identify the X or row conductors of the matrix, while the terminals C0 through C3 also identify the Y or column conductors of the matrix.

The switches S0–S15 may be interconnected by wires inserted through holes disposed in the printed circuit board 32, which are soldered to the stationary contacts, or preferably by conductive portions plated or etched on the surface of the printed circuit board 32 which are integrally connected to the associated stationary contacts and brought to the edge of the printed circuit board.

If the switches S0–S15 are actuated by bridging the stationary electrodes or contacts with a direct metallic connection, there will be very little attenuation of a unidirectional signal applied to the X or row conductors as it proceeds through a plurality of simultaneously closed switches. To prevent false indication of a call through a plurality of simultaneously closed switches through "sneak" circuits, a rectifier or diode should be connected from each row conductor R0 through R3 to the first stationary electrodes of the switches, such as rectifier 40 connected from row conductor R3 to the first electrode 34 of switch S12, with the rectifier being poled as indicated in the figure. If the switches S0–S15 are of the capacitive type, the amount of signal attenuation through the capacitance of each switch will prevent false indication of a call through a plurality of simultaneously actuated switches, and thus the rectifiers are not required.

The rows R0 through R3 are selectively enabled by a row driver circuit 50 which may include dual input AND gates 52, 54, 56 and 58 which have their outputs connected to input terminals R0, R1, R2 and R3 respectively. The AND functions may be performed by RCA's COS/MOS Quad 2-input NAND gate CD 4011A with inverters CD 4049A, for example. The columns C0 through C3 are selectively enabled by a column driver circuit 60, such as RCA's COS/MOS Analog Multiplexer CD 4052A.

In the prior art, the matrix of switches S0–S15 would be scanned by providing a 4-stage binary counter 62, such as by using four stages of RCA's COS/MOS 7-stage binary counter CD 4024A, driven by a clock 64 which provides input pulses for advancing the count value. The clock 64 may be a 4 KHz. oscillator formed of COS/MOS NAND inverter or NOR gates, such as RCA's COS/MOS NOR gate CD 4001, connected as shown on page 531 of RCA's Solid State Data Book Series, Book SSD-203C, 1975 edition. The most significant bit D of the scan counter 62 is connected directly to an input on each of the AND gates 56 and 58, and to an input on each of the AND gates 52 and 54 via an inverter 66. The next most significant bit C is connected directly to an input on each of the AND gates 54 and 58, and to an input on each of the AND gates 52 and 56 via an inverter 68. The two least significant bits A and B are connected to inputs on the analog multiplexer 60. This arrangement successively energizes rows R0 through R3, and while each row is energized, the analog multiplexer successively connects each column conductor C0 through C3 to the output OUT.

The binary address of switch S0 is 0000, and when the output of counter 62 is 0000 the condition of switch S0 will be monitored. If the switch S0 is actuated, the output OUT will be high during the count value 0000, and if it is not actuated, the output OUT will be low during this scan or time slot. Scan slot 0000 would be assigned to the lowest floor of the building, and thus when switch S0 is actuated a car call for the lowest floor of the building would be registered. In like manner, the address of switch S1 is 0001, the address of switch S2 is 0010, etc., with the switches being associated with successively higher floors of the building. With 16 floors in the building and with horizontally increasing notations applied to the switches on the call entry panel, the prior art clock and counter arrangement described will perform the scanning of the matrixed switches correctly. The problem arises when there are fewer floors than switches in the matrix, and/or the notations increase vertically instead of horizontally. In these situations, extensive rewiring of the matrix is necessary, which offsets the value gained by the batch processing of the matrixed switches.

The wiring problem created by using fewer switches than included in the matrix, and/or by notations which increase vertically instead of horizontally, is solved, according to the teachings of the invention, by connecting a programmable memory device 70 between the output of the scan counter 62 and the inputs to the row driver decoder 50 and the analog multiplexer 60. The memory device 70 may be a discrete diode circuit board, a diode matrix IC, or preferably, a programmable read-only memory IC. For purposes of example, a read-only memory such as Intersil's IM 5600 will be used for device 70. This particular memory provides 32, 8-bit binary output words, permitting an $8 \times 4$ matrix to be used, but since thematrix in the example is a $4 \times 4$ matrix, only 4 bits and 16 output words are used. The most significant bit (MSB) is tied to logic zero. The output of the scan counter 62 is the input word for the memory device 70, and the memory device 70 is programmed to provide binary switch addresses in the sequence selected by the specific notations applied to the switch locations, as the scan counter counts through the scan slots 0000 through 1111.

For purposes of example, it will be assumed that the building has 16 floors and that the notations applied to the switches S0 through 15 increase vertically as illustrated on the display panel 520″ in FIG. 2. While the display panel 520″ is shown separated from the call entry portion 520′ in FIG. 2, in use it would be placed over the call entry portion such that the button with the notation L is in front of switch S0, etc. Thus, depressing the button or the notation L actuates switch S0. The notations associate the lowest level in the building with the letter L, while the highest level is associated with the number 17, since it is conventional to omit the number 13.

Figures 3, 4, 5:
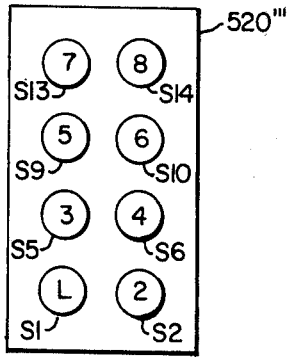
FIG. 3 is a chart which illustrates the programming of a read-only memory used in the car call entry and display station of FIG. 2.
FIG. 4 is an elevational view of the car call entry panel shown in FIG. 2, in which less than the available number of car call switches are utilized, with the switch notations applied to the active switches of the panel increasing numerically in the horizontal direction.
FIG. 5 is a chart which illustrates the programming of a read-only memory used in the car call entry and display station of FIG. 2, for the switch and notation arrangement shown in FIG. 4.

FIG. 3 is a chart which illustrates how the read-only memory 70 would be programmed for the FIG. 2 notation arrangement. The binary output word 0000 of counter 62 is associated with the lowest level L, which is assigned in FIG. 2 to switch S0. Thus, when the input word is 0000, the output word of the read-only memory 70 will be the binary address of switch S0, which is 0000. The next floor level, floor No. 2, which is associated with scan slot value 0001, is assigned in FIG. 2 to switch S4. Thus, the output word of read-only memory 70 will be the binary address of switch S4, which is 0100. The programming then proceeds to the next level, assigned by the notation of FIG. 2 to switch S8, etc.

FIG. 4 illustrates a call entry panel 520''' with a horizontally increasing display notation for a building having eight floors. The display panel exterior is centered over the switch matrix 520' of FIG. 2, and thus only switches S1, S2, S5, S6, S9, S10, S13 and S14 are active. FIG. 5 is a chart which illustrates how the read-only memory 70 would be programmed to scan the FIG. 4 notation arrangement. The lowest floor, assigned to scan slot 0000 is associated with switch S1 and thus an input word of 0000 must provide the address 0001, which is the binary address which will monitor switch S1. The next floor level, floor No. 2, is associated with scan slot 0001, and the display notation of FIG. 4 selects switch S2 for floor No. 2, and thus an input word of 0001 to the read-only memory 70 provides an output address 0010, the address which will monitor switch S2, etc. When the scan slots 1000 through 1111, which are not associated with a floor, are applied as inputs to the read-only memory 70, the memory 70 is programmed to provide an output which is an inactive address, i.e., an address which will not monitor an active switch.

Returning to FIG. 2, the output OUT of the analog multiplexer 60 provides indications of car calls in serial form, which calls must be stored until reset, and the stored calls must be provided in serial form for transmission to the remotely located floor selector. The call storage function, illustrated in block form as block 24 in FIG. 1, may include a one to 16 demultiplexer 72, such as RCA's CD 4515B, for demultiplexing the serial car call signal OUT, a one to 16 demultiplexer 74 for demultiplexing the serial car call reset, a power voltage to logic voltage interface 904 for reducing the voltage level of the serial car call reset signal $\overline{PCCR}$ to provide the serial car call reset signal $\overline{CCR}$, and car call memory elements 76, such as 16 J-K flip-flops, which are responsive to the outputs of the demultiplexers 72 and 74.

Each of the demultiplexers 72 and 74 receive the output of the read-only memory 70, which is decoded to enable the proper gate in the demultiplexer to steer the car calls, and car call resets to the correct memory element in the car call storage 76.

The 16 outputs of the car call storage 76 are connected to a 16 to one multiplexer 900, such as RCA's CD 4067B, which also receives the output of the read-only memory 70. The output of the read-only memory 70 is decoded in multiplexer 900 to enable the 16 inputs to the multiplexer in the proper order. The serial output $\overline{READ}$ of multiplexer 900 is applied to a logic voltage to high voltage interface 902 to provide a high voltage signal $\overline{PREAD}$ for transmitting the serial car calls over the electrically noisy traveling cable 532.

The 16 outputs of the car call storage 76 are also connected to the display function 520'' of the call entry and display station 520, to drive the appropriate indicator and display the registration of the call to the passengers in the elevator car. While any suitable indicator may be used for displaying the call, it is preferably a display of the field effect liquid crystal type, such as disclosed in the concurrently filed application Ser. Nos. 578,301, and 587,302, filed May 16, 1975, which applications are assigned to the same assignee as the present application.

In another concurrently filed application Ser. No. 578,304, filed May 16, 1975, in the names of A. Mandel and L. Vercellotti, which application is assigned to the same assignee as the present application, a new and improved universal solid state car position indicator with a solid state display, preferably field effect liquid crystals, is disclosed. Field effect liquid crystals are preferred for use in the car position display, and also in the car call dislay, both of which are mounted in the elevator car, because field effect liquid crystals require very little power, they have a high contrast, a wide viewing angle, they have a relatively low cost, and they are directly compatible with COS/MOS logic, i.e., the same voltage and power density requirements. Field effect liquid crystal displays and associated COS/MOS logic only require a current of about 2 milliamperes, which permits a simple, low cost Zener diode/resistor power supply to be connected to the +125 volt DC voltage which is available in the elevator car for driving safety relays. However, adding a programmable read-only memory to the display, as in both the last mentioned co-pending application and the present application, seems to rule out a low cost Zener diode power supply because the presently available read-only memories require a well regulated +5 volt DC supply voltage, with a maximum current of about 100 milliamperes. The last mentioned copending application solved this problem by applying voltage to the read-only memory for 60 microseconds out of every 3.84 milliseconds, which arrangement reduces the average current used by the read-only memory to 1.56 milliamperes, which enables a low cost Zener diode power supply to be used. The read-only memory 70 in the car call entry and display station of the present application is preferably pulsed as taught by this copending application, from a Zener diode/resistor power supply. The pulsing implementation described in this copending application may be used if desired. The present application discloses a new and improved pulsing arrangement, which alternatively may be used.

Figure 6:
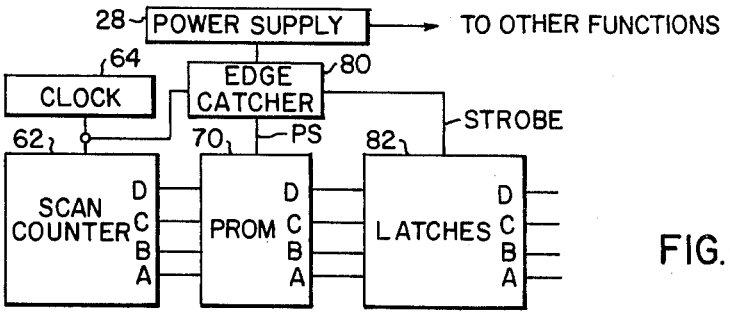
FIG. 6 is a block diagram which illustrates a new and improved power supply arrangement for the read-only memory used in the car call entry and display station, which arrangement simplifies the power supply required in the elevator car.

More specifically, FIG. 6 illustrates a modification of FIG. 2 wherein the read-only memory 70 is pulsed for 5 microseconds out of every 250 microseconds, a ratio of on to off time of 1 to 50, which reduces the average current drawn by the read-only memory 70 to a maximum of only 2 milliamperes. The 4 KHz. clock changes the output of the scan counter 62 every 250 microseconds, and the read-only memory 70 must be energized and read after each change in the scan count. The output of the clock 64 is applied to an edge catcher circuit 80, such as RCA's dual monostable CD 4098B, which detects the negative going transitions of the clock 64. Each negative going transition is differentiated by a resistor and capacitor differentiation circuit to provide a signal which initiates first and second pulses PS and STROBE. Pulse PS is a 5 microsecond pulse which is used to energize the read-only memory 70. The outputs of the read-only memory 70 are applied to a latch circuit 82, such as RCA's CD 4042AE, which latches or stores the information appearing at its inputs when its latch line is driven low. Pulse STROBE is connected to the latch line of the latch circuit 82, driving the latch line low 3 microseconds after the read-only memory 70 is energized to thus store the output count of the read-only memory 70 until the next change occurs in the output of the scan counter. The output of the latch circuit 82 is used as though it were the output of the read-only memory 70 in FIG. 2.

Figure 7:
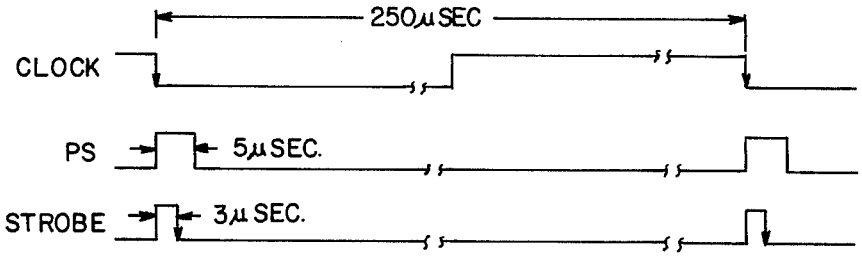
FIG. 7 is a graph illustrating the waveforms of certain signals developed in th power supply arrangement shown in FIG. 6.

FIG. 7 is a graph which illustrates the relationship between the 250 microsecond cycle of the clock 64 and the pulses PS and STROBE provided by the edge catcher circuit 80. As illustrated in FIG. 7, when the negative going transition of the clock occurs, the two pulses PS and STROBE are initiated, with the pulse STROBE terminating prior to the termination of pulse PS. This pulse arrangement provides sufficient time for the read-only memory to build up its output signals, and the output signals are stored before the termination of the pulse PS which is providing power for the read-only memory.

Figure 8:
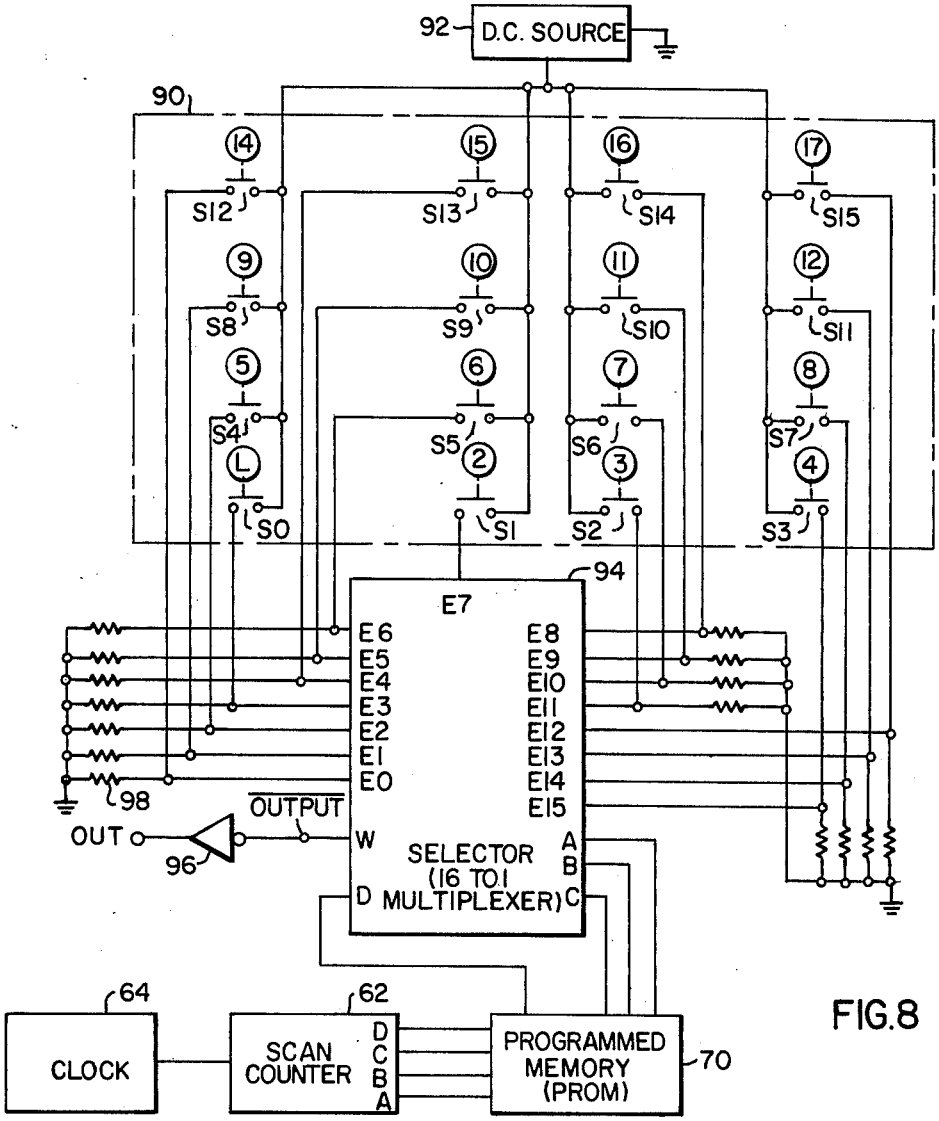
FIG. 8 is a schematic diagram of a car call entry and display station constructed according to another embodiment of the invention, which station may be used in the elevator system shown in FIG. 1.

While the FIG. 2 embodiment illustrates a preferred embodiment of the invention wherein the stationary contacts of the switches are connected in a matrix, the teachings of the invention are equally applicable to parallel connected switches. FIG. 8 is a schematic diagram illustrating an embodimment of the invention wherein a call entry and display panel 90 has 16 parallel connected switches S0 through S15. The stationary contacts of the switches, and the conductors connecting the stationary contacts, may all be printed or plated on a common printed circuit board if desired. One stationary contact of each of the switches is connected to a source 92 of DC potential, and the other stationary contacts are each connected to an input of a selector 94, such as a 16 to one multiplexer. The output of the read-only memory 70 is connected to the selector 94, to connect the proper switch to the output terminal $\overline{\text{OUTPUT}}$. Terminal $\overline{\text{OUTPUT}}$ is connected to an inverter 96, to provide the serial car call signal OUT. As illustrated in FIG. 8, the terminals of the selector 94 which are connected to a switch are also connected to ground through a resistor, such as a resistor 98 connected to terminal E0, which is also connected to a stationary contact of switch S12. Thus, the terminal is held at ground potential until the associated switch is actuated. The selector 94 may be Texas Instrument's SN 74150, or a COS/MOS equivalent.

FIGS. 9 and 10 are charts which illustrate the programming of read-only memory 70 shown in FIG. 8 for the horizontally increasing notations of FIG. 8, and for the vertically increasing notations, such as shown in the display 520" in FIG. 2, respectively. The wiring of the display 90 is thus standardized, regardless of the order in which the switches are selected by the display notations, by the addition of the programmed read-only memory 70.

I claim as my invention:

1. An elevator system, comprising:

an elevator car mounted for movement in a building to serve the floors therein, call entry means disposed in said elevator car, said call entry means including a plurality of switches, notation means identifying the floor each switch is associated with, and means for operating each switch to register a call, p1 selector means for addressing a selected switch of said plurality to detect the operation thereof, counter means for providing a continuously changing count value, and memory means programmed to provide predetermined switch addresses for said selector means in response to predetermined count values of said counter means, with the predetermined switch addresses being provided by said memory means in a sequence which directs said selector means to monitor the switches in the order selected by said notation means.

2. The elevator system of claim 1 including storage means for storing calls detected by the selector means, means serializing the calls stored in said storage means, and means removing a call from said storage means when the elevator car answers the call.

3. The elevator system of claim 1 wherein the switches include stationary contacts disposed on a common printed circuit board.

4. The elevator system of claim 1 wherein the switches are interconnected in a matrix having row and column conductors, and wherein the selector means includes means connected to the row and column conductors, with the switch address provided by the memory means selecting predetermined row and column conductors to monitor the switch associated therewith.

5. The elevator system of claim 1 wherein the switches include stationary contacts disposed on a common printed circuit board and interconnected in a matrix having row and column conductors, and wherein the selector means includes means connected to the row and column conductors responsive to the switch address for selecting a predetermined row conductor and a predetermined column conductor.

6. The elevator system of claim 1 wherein the memory means is a programmable read-only memory.

7. The elevator system of claim 1 including pulse means responsive to the counter means changing its count value for energizing the memory means for a predetermined short period of time each time the counter means provides a new count value, and wherein the memory means includes storage means for storing the switch address provided by the memory means when it is energized, with the storage means providing the stored switch address for the selector means.

8. The elevator system of claim 7 wherein the pulse means provides a first pulse for a predetermined first time duration when the counter means changes its count value, with the first pulse energizing the memory means, and a second pulse for a duration shorter than the first time duration, with the second pulse being applied to the storage means for storing the output of the memory means at the termination of the second pulse.

9. Switch monitoring apparatus, comprising:

a plurality of switches, counter means, clock means driving said counter means to provide a changing count value, selector means for addressing a predetermined switch of said plurality and for indicating the condition of the addressed switch, and memory means programmed to provide a predetermined switch address for said selector means in response to at least certain of the count values of said counter means, to sequentially monitor said plurality of switches in a predetermined sequence.

10. The switch monitoring apparatus of claim 9 wherein the switches include stationary contacts disposed on a common printed circuit board.

11. The switch monitoring apparatus of claim 9 wherein the switches are interconnected in a matrix having row and column conductors, and wherein the selector means includes means connected to the row and column conductors, with the switch address provided by the memory means selecting predetermined row and column conductors to monitor the switch associated therewith.

12. The switch monitoring apparatus of claim 9 wherein the switches include stationary contacts disposed on a common printed circuit board and interconnected in a matrix having row and column conductors, and wherein the selector means includes means connected to the row and column conductors responsive to the switch address for selecting a predetermined row conductor and a predetermined column conductor.

13. The switch monitoring apparatus of claim 9 wherein the memory means is a programmable read-only memory.

14. The switch monitoring apparatus of claim 9 including pulse means responsive to a change in count value of the counter means for energizing the memory means for a predetermined short period of time each time the counter means provides a new count value, and wherein the memory means includes storage means for storing the switch address provided by the memory means when it is energized, with the storage means providing the stored switch address for the selector means.

15. The switch monitoring apparatus of claim 14 wherein the pulse means provides a first pulse for a first predetermined time duration when the counter means changes its count value, with the first pulse energizing the memory means, and a second pulse for a duration shorter than the first time duration, with the second pulse being applied to the storage means for storing the output of the memory means at the termination of the second pulse.

16. Switch monitoring apparatus, comprising:

a plurality of switches, binary counter means having an input and an output, clock means connected to the input of said binary counter means to provide a changing count value at the output of the binary counter means, selector means connected to said plurality of switches, said selector means having an input for addressing a predetermined switch of said plurality of switches, and an output for indicating the condition of the addressed switch, and memory means having an input connected to the output of said binary counter means, and an output connected to the addressing input of said selector means, said memory means being programmed to provide a predetermined output count value for each binary input count value from said binary counter means to select a monitoring sequence for serially monitoring said plurality of switches which differs from the sequence which would be obtained by connecting the output of the binary counter means to the addressinng input of the selector means.

* * * * *